US005890326A

United States Patent [19]

Gallant et al.

[11] Patent Number: 5,890,326

[45] Date of Patent: Apr. 6, 1999

[54] HEAD WALL FOR A HOSPITAL ROOM

[75] Inventors: Dennis J. Gallant, Harrison; Linda A. Hillier, Cincinnati, both of Ohio; Dale A. Nobbe, Oldenburg, Ind.; Ares Marasligiller, Villa Hills, Ky.; Michael Buccieri, Greenfield, Ind.; Douglas C. Ambach, Hamilton, Ohio

[73] Assignee: Hill-Rom, Inc., Batesville, Ind.

[21] Appl. No.: 743,710

[22] Filed: Nov. 6, 1996

[51] Int. Cl.[6] ..... A47F 10/00; E04H 1/00

[52] U.S. Cl. ..... 52/36.1; 52/36.4; 52/220.1; 52/220.5; 52/27; 52/28; 52/220.7

[58] Field of Search ..... 52/36.1, 36.4, 52/28, 220.1, 220.5, 220.7, 220.8, 27; 312/209, 223.1, 297, 223.5, 223.6

[56] References Cited

U.S. PATENT DOCUMENTS 3,462,892 8/1969 Meyer ..... 52/28
3,567,842 3/1971 Meyer ..... 52/27 X
4,589,557 5/1986 Bollmann ..... 52/36.4 X
4,905,433 3/1990 Miller ..... 52/220.1 X
5,277,005 1/1994 Hellwig et al. ..... 52/220.1

*Primary Examiner*—Carl D. Friedman
*Assistant Examiner*—W. Glenn Edwards
*Attorney, Agent, or Firm*—Barnes & Thornburg

[57] ABSTRACT

A head wall apparatus includes a support configured to be coupled to a wall, and a front panel coupled to the support to define an interior region of the head wall. The front panel includes an elongated opening. The apparatus also includes a gas block having an inlet and an outlet, and a shield configured to extend over the opening. The shield defines a track for slidably coupling the gas block to the head wall. The shield is configured to block access to the interior region of the head wall. A gas supply line located in the interior region of the head wall is coupled to the inlet of the gas block.

29 Claims, 8 Drawing Sheets

HEAD WALL FOR A HOSPITAL ROOM

BACKGROUND AND SUMMARY OF THE INVENTION

The present invention relates to a head wall apparatus for a hospital room.

Conventional head wall designs for hospital rooms include electrical outlets and fixed or movable gas outlets for supplying air, oxygen, or a vacuum to the hospital room. In conventional head wall designs, movable gas outlets slide on a track formed on the head wall. These conventional tracks typically have an opening or gap which permits the gas outlet to slide relative to the head wall. While these movable gas outlets are convenient, the opening or gap in the head wall may allow dust, splashed fluids, or other items to enter an interior region of the head wall. In addition, people within the hospital room are able to drop items into the track opening. These items fall into the interior region of the head wall.

The head wall of the present invention provides an improved configuration for supporting movable gases. An elongated shield extends upwardly and provides a track for receiving the adjustable gas outlets or blocks. The shield extends along the length of the head wall to block dust, fluids, or other items from entering an interior region of the head wall. Preferably, a pair of the elongated shields are provided on the head wall. One shield is located near a top portion of the head wall, and another shield is located near a bottom portion of the head wall to serve as upper and lower adjustable gas tracks. The gas blocks of the present invention include a swivel connection so that the gas blocks can be used either on the top shield track or the bottom shield track.

The head wall of the present invention further includes a storage region located near a top portion of the head wall. The main body of the head wall includes a recessed surface located near the top end of the head wall. A pivotable cover is coupled to the body of the head wall above the recessed portion. The pivotable cover can be pivoted upwardly to expose the storage region. The top end of the head wall is closed by the recessed surface to prevent items in the storage region from falling into the interior region of the head wall.

Accessory items can be coupled to a top edge of the head wall body which defines a mounting track. Mounting brackets are provided which engage the mounting track of the head wall. These mounting brackets are configured to permit items to be stacked on top of each other. In other words, the accessory items are vertically stackable or nestable in order to save space on the head wall. For instance, a shelf may be mounted to the top track of the head wall. A basket or other accessory item can then be mounted vertically above the shelf using the mounting brackets of the present invention.

One illustrated embodiment of the head wall of the present invention includes a front cover pivotally coupled to the support and concealing the outlets on the front wall of the support structure in a concealed position. A lock coupled to the support above the pivot of the cover engages the top end of the front cover to hold the front cover in the concealed position. A second lock coupled to the support below the pivot of the front cover engages the top of the front cover to hold the front cover in a stored position which exposes the outlets in the front wall.

The head wall of the present invention also facilitates upgrading of the number and position of gas outlets coupled to the head wall if the need for gas outlets within the hospital room increases.

An initial installation of the head wall may be provided with minimum services at a minimum cost. This initial installation typically includes fixed outlets for air, vacuum, and oxygen with flexible hoses coupled to gas inlet connections into the hospital room. Conventional head wall designs include a copper manifold having a brazed connection with a copper inlet lines. Brazed connections are also made between the manifold and the connector for the particular gas outlet block.

In the present invention, check valves are coupled to the ends of each of the copper inlet lines. In initial installation, single flexible hoses are coupled to the check valves and to the gas outlet blocks. If the hospital needs to add additional gas and vacuum outlet blocks, the original hoses are disconnected from the check valve of the inlet lines. A manifold assembly is then coupled to each inlet line. The manifold assembly preferably includes a threaded coupling for connecting the manifold to the check valve of the inlet line and at least two check valves extending from the manifold to permit at least two gas blocks to be coupled to each inlet line. Gas outlets are then connected to the check valves of the manifold with flexible hoses with suitable gas specific threaded couplings.

A modular manifold can also be used if the hospital needs to add gases and vacuum. The original single flexible hose connection to the inlet check valve is first disconnected. Individual coupling lines and manifold blocks are then assembled and connected to the inlet line check valve as needed. Each manifold block includes an internal check valve. The manifold block can be coupled to the inlet check valve or to another manifold block with flexible hose having gas specific threaded couplings at each end. At least two of the T-connector manifold blocks are coupled to the inlet line to permit additional gas or vacuum outlets to be added to the head wall quickly and inexpensively.

Additional objects, features, and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF DRAWINGS

Figure 1:
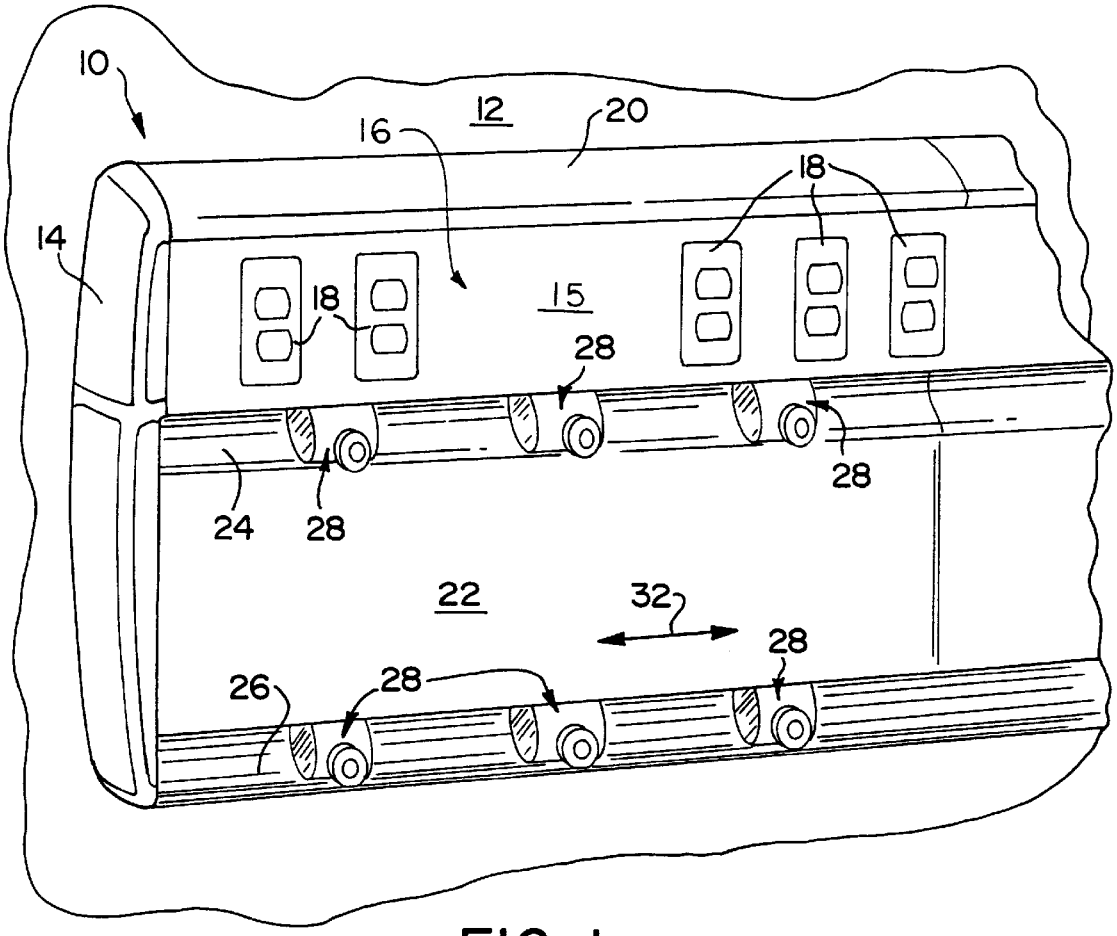
FIG. 1 is a perspective view of one embodiment of the head wall apparatus of the present invention which includes top and bottom shields defining upper and lower tracks for receiving movable, adjustable gas outlet blocks.

Referring now to the drawings, FIG. 1 illustrates a head wall 10 configured to be mounted on a wall 12 of a hospital room. The head wall 10 includes an end cap 14, an upper raceway 16 having in a upper raceway cover 15 a plurality of electrical outlets 18 coupled to electrical wires of the hospital room in a conventional manner. A pivotable concealment cover 20 is located along a top end of head wall 10 as discussed in detail below.

Head wall 10 further includes a front concealment cover 22 and upper and lower shields 24 and 26, respectively. The shields 24 and 26 are elongated shields which extend along the length of the head wall 10. Shields 24 and 26 each provide a track for receiving movable, adjustable gas blocks 28. The shields 24 and 26 block or close an opening in the head wall and define a track for the gas blocks 28. Therefore, shields 24 and 26 prevent dust or fluids, or other items such as trash from entering an interior region 74 of head wall 10.

Figure 2:
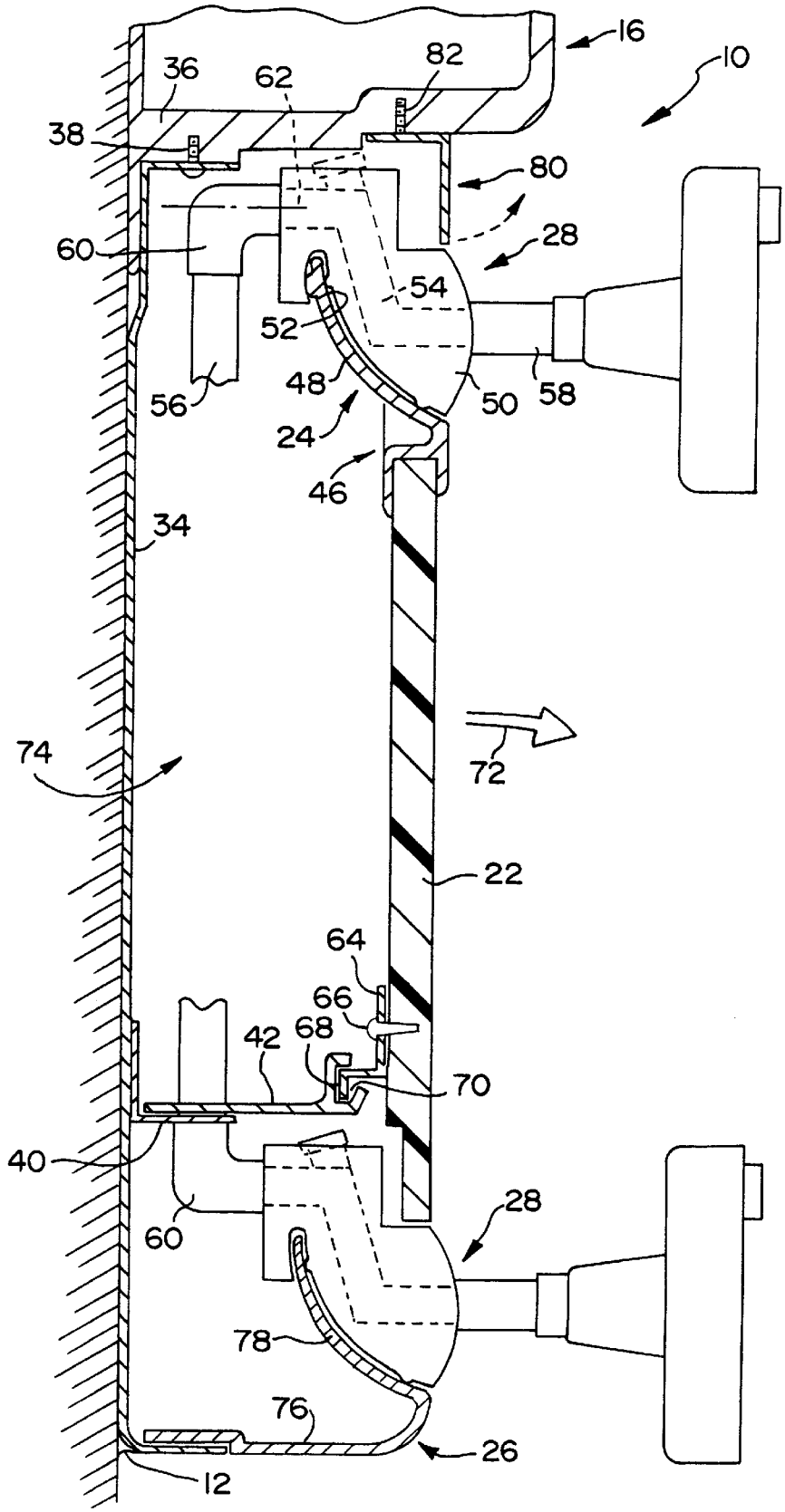
FIG. 2 is a sectional view taken through the head wall of FIG. 1 further illustrating details of upper and lower sliding adjustable gas blocks located on the elongated top and bottom shields, respectively.
Figure 3:
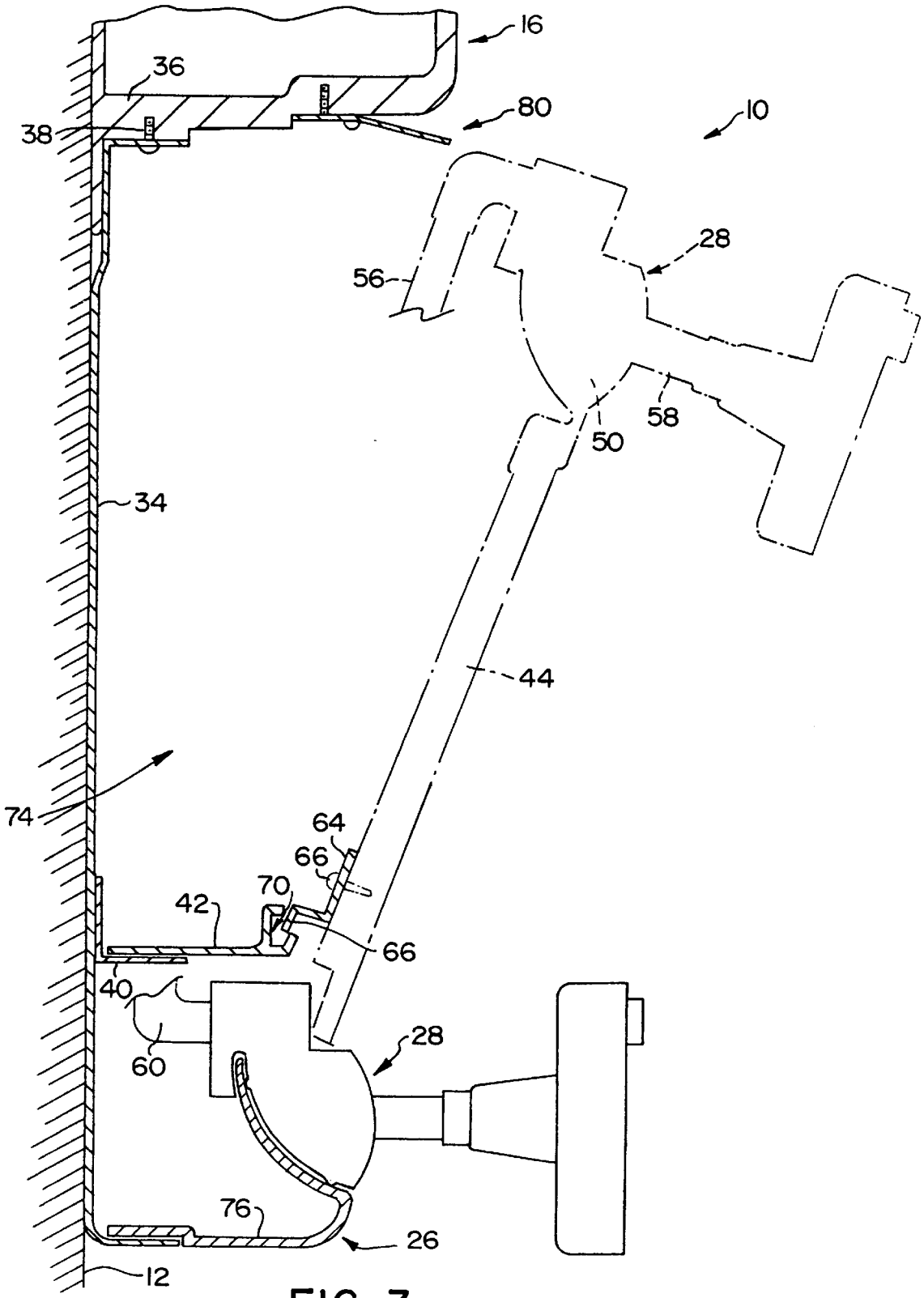
FIG. 3 is a sectional view similar to FIG. 2 in which a front cover panel, the top shield, and the upper gas block have been pivoted outwardly away from the head wall to provide access to an interior region of the head wall.

The configuration of head wall 10 is best illustrated in FIGS. 2 and 3. Head wall 10 includes a rear support bracket 34 coupled to wall 12 with suitable fasteners (not shown). Bracket 34 is also coupled to a top section 36 by fasteners 38. L-bracket 40 is coupled to bracket 34. Mounting clips 42 are coupled to L-bracket 40. Upper shield 24 is coupled to a top end of front panel 22. Upper shield 24 includes a U-shaped channel 46 located over the top end of front panel 22. Shield 24 further includes a curved, upwardly extending member 48 defining a track for receiving the gas blocks 28.

Gas blocks 28 include a body portion 50 formed to include a groove 52 for receiving a top end of track member 48 of shield 24. Body 50 includes an internal passageway 54 to permit gas flow from a flexible hose 56 to an outlet 58. Hose 56 is coupled to gas block 28 by a swivel connection 60. The gas inlet 62 of gas block 28 extends horizontally and is located above the gas outlet 58 to accommodate the upwardly angled track member 48 of shield 24.

A mounting bracket 64 is coupled to an inside wall of front panel 44 by a suitable fastener 66. An end 68 of bracket 64 is configured to be located within a channel 70 of bracket 42 to pivotably couple the front panel 22, the shield 24, and the gas outlet 28 to the mounting bracket 42. Therefore, the front panel 22, the shield 24, and the gas outlet 28 can be pivoted outwardly in the direction of arrow 72 to the position illustrated in FIG. 3. This provides access to an interior region 74 of head wall 10.

An upper flip door 80 is coupled to top member 36 by suitable fasteners 82. The flip door 80 may have a mechanical hinge or may be made from a flexible extruded material. The door 80 is outwardly pivotable to the position illustrated in FIG. 3 to permit the front panel 44, the shield 24, and the gas block 28 to be pivoted outwardly to the position of FIG. 3 for access to the interior region 74 of head wall 10.

The bottom shield 26 includes a horizontal section 76 coupled to rear panel 34 and an upwardly or vertically extending curved member 78 which provides the shield and defines a track for the lower gas outlets 28. Shield 26 also provides a bottom cap for head wall 10.

Preferably, shields 24 and 26 are formed from an extruded plastic or aluminum material. The shields 24 and 26 block openings into the interior region 74 of head wall 10. This prevents dust or dirt, fluids, or trash, or other items from entering interior region 74 of head wall 10.

The lower gas blocks 28 slide along track 26 in a manner as described above in connection with the upper gas blocks 28 on upper shield 24. The gas blocks 28 can be used in either the upper location or the lower location by adjusting the swivel connection 60 to face either downwardly or upwardly, respectively, as illustrated in FIG. 2. Swivel connections 60 can rotate 360° relative to the gas blocks 28. Another embodiment of the shield and gas block is discussed below with reference to FIGS. 12 and 13.

Figure 4:
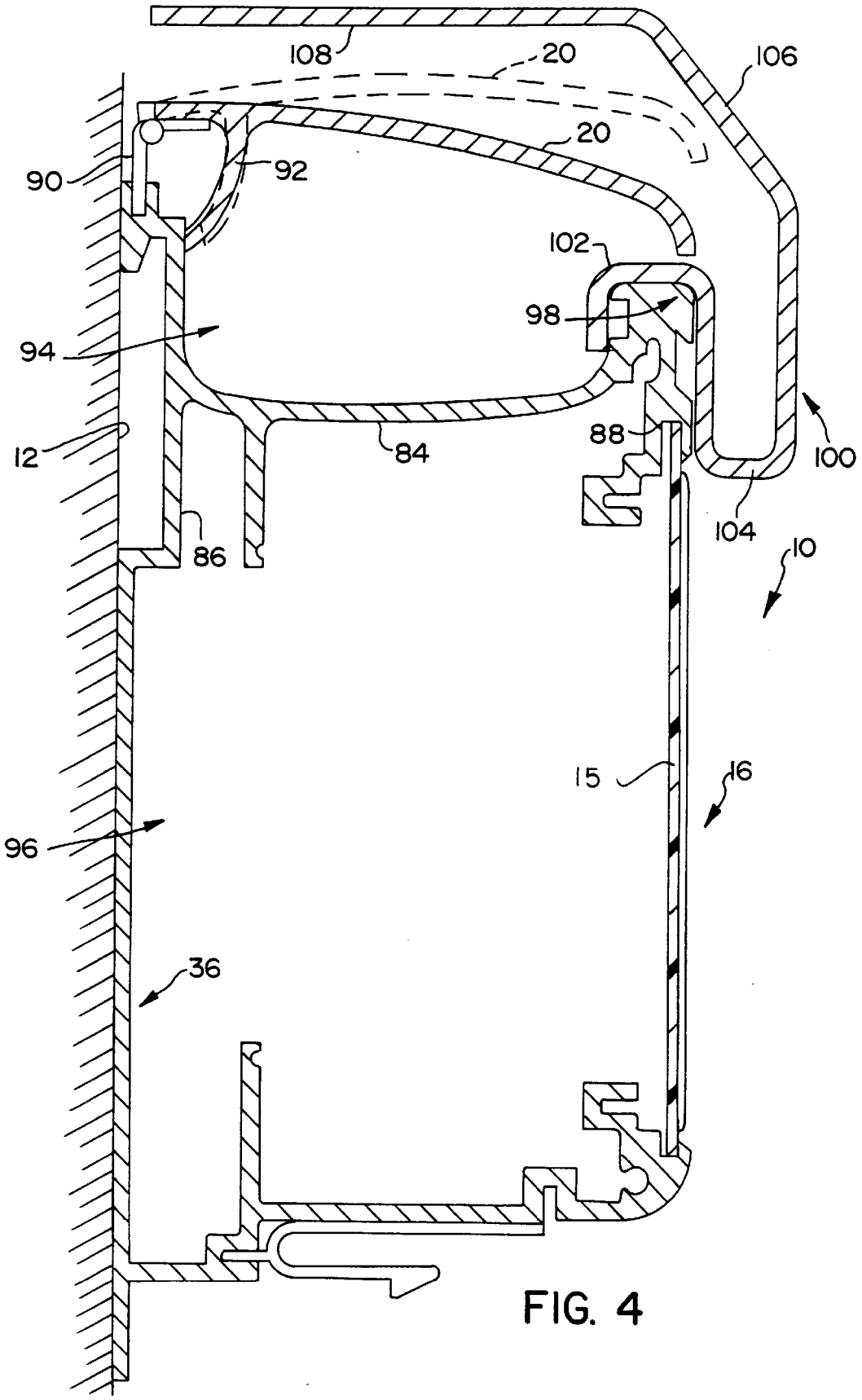
FIG. 4 is a sectional view taken through another embodiment of the present invention which includes a top storage compartment and a pivotable cover to permit accessory items to be coupled to a top track of the head wall.

FIG. 4 illustrates an embodiment of the upper raceway 16 and concealment cover 20 of the present invention. Upper raceway section 16 includes the extruded member 36 configured to be coupled to wall 12. Extruded member 36 includes a top recessed surface 84 extending between a rear wall 86 and front wall 88. Cover 20 is pivotably coupled to support member 36 by hinge 90. Cover 20 includes a stop arm 92 for engaging rear wall 86 to limit pivotable movement of cover 20.

An upper storage compartment 94 is defined between top surface 84 and cover 20. Top surface 84 prevents items from being dropped into an interior region 96 of raceway 16. Support member 36 includes a top track 98 adjacent front wall 88. Track 98 permits accessory items to be coupled to head wall 10. In order to couple accessory items to head wall 10, the cover 20 is pivoted upwardly to the dotted position of FIG. 4. An appropriate mounting bracket 100 includes a first U-shaped section 102 for engaging the track 98, a second U-shaped section 104, an angled section 106, and a top horizontal section 108. Accessory items can be mounted on horizontal section 108 as discussed in detail below.

Figure 5:
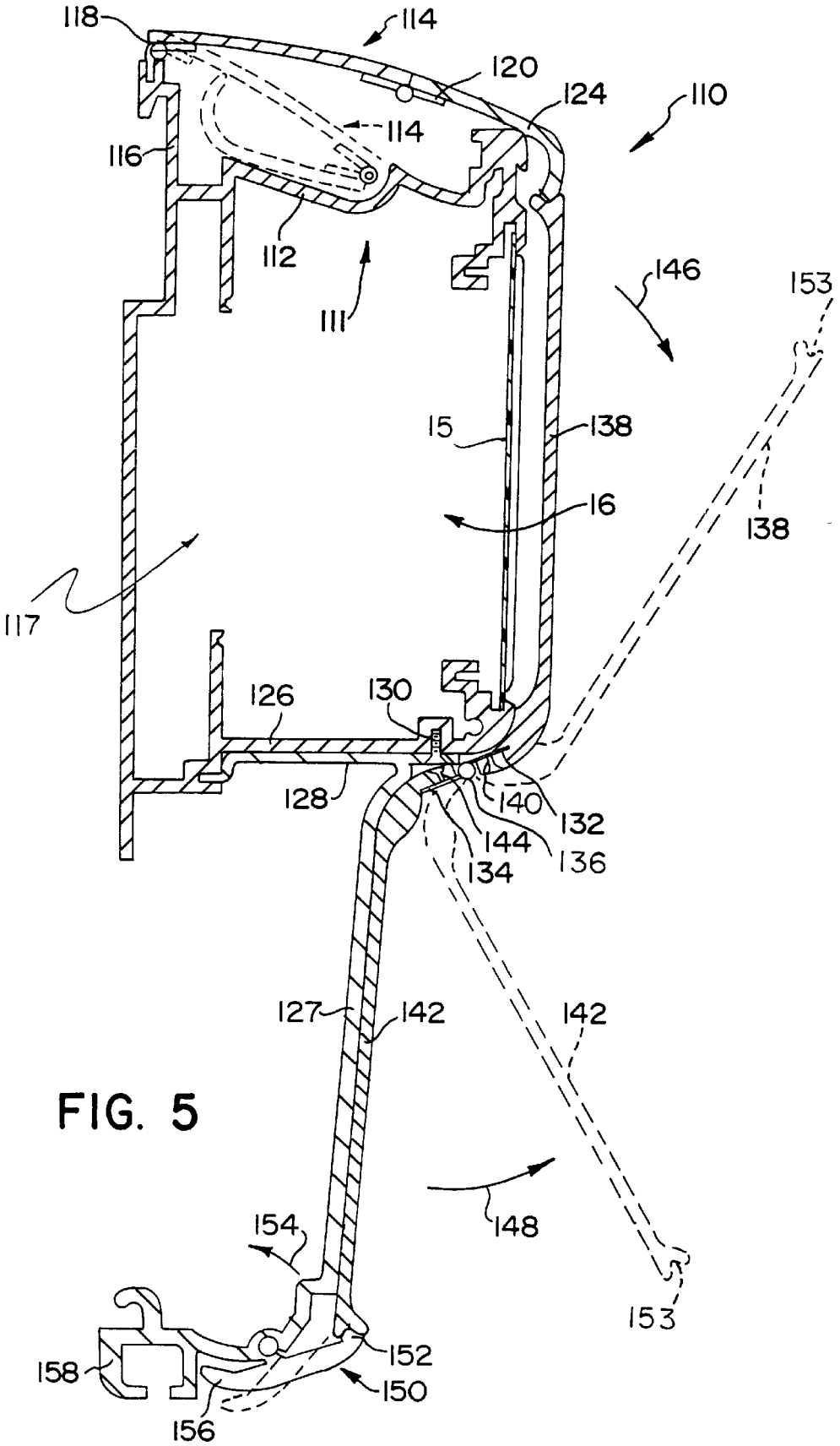
FIG. 5 is a sectional view illustrating another embodiment of the present invention including a top cover and storage compartment and illustrating a concealment cover which is pivotal relative to the head wall body.

FIG. 5 illustrates another embodiment of the top concealment cover of the present invention, along with upper and lower front concealment covers 138 and 142. In the FIG. 5 embodiment, top surface 112 of the head wall 110 includes a recessed portion 112. The top concealment cover 114 is pivotably coupled to rear wall 116 by hinge 118. Another hinge 120 connects first and second sections 122 and 124 of top concealment cover 114 together. Top concealment cover 114 can be pivoted inwardly to the nested position illustrated in FIG. 5 when it is desired to couple items to the head wall. Head wall 110 also includes a bottom support surface 126. A mounting bracket 128 is coupled to bottom support surface 126 by fasteners 130.

First and second hinges 132 and 134 are also coupled to lower support surface 126 by fasteners 130 for movement about a pivot axis 136. Hinges 132 are coupled to the pivotable upper front concealment cover 138 by fasteners 140. Hinges 134 are coupled to lower front concealment cover 142 by suitable fasteners 144. Upper cover 138 can pivot downwardly about pivot axis 136 in the direction of arrow 146 to the dotted position illustrated in FIG. 5 to expose outlets 18 and other receptacles in cover 15 of the upper raceway 117. Lower cover 142 can pivot upwardly in the direction of arrow 148 about pivot axis 136 to the dotted position 142.

A bottom locking foot 150 includes a head 152 for engaging a notch 153 formed in lower cover 142 to hold the cover 142 in position on head wall 110. Locking head 152 is spring biased in the direction of arrow 154 to hold the cover 142 in position. In order to move the cover 142, an actuator section 156 is pushed inwardly to release the head 152 from the concealment cover 142 and permit pivotable movement in the direction of arrow 148. The cover 138 is locked in the solid position by section 124 of the top cover 114 resting in notch 153 of the cover 138.

A section of a C-shaped section 158 is formed integrally with mounting section 127. Accessory items (not shown) can be coupled to the C-shaped section 158.

Figure 6:
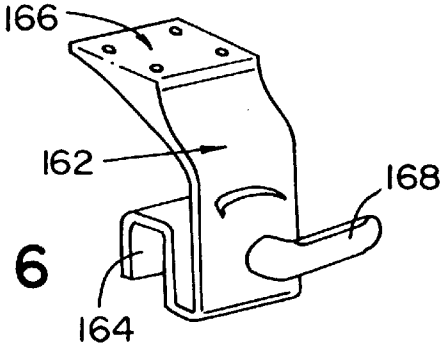
FIG. 6 is a perspective view of a lockable mounting bracket for coupling accessories to a top track of the head wall.

FIG. 6 illustrates another embodiment of a mounting bracket for coupling accessory items to the head wall of the present invention. In this embodiment, the bracket 162 includes a U-shaped channel 164 for engaging the top track 98 of the head wall 10 and a mounting portion 166 for securing the bracket 162 to an accessory item. The mounting bracket 162 includes a lock handle 166 which is rotatable to secure the mounting bracket 162 to the top track 98. Rotation of handle 166 causes engagement of a locking member with a portion of the track 98 to prevent movement of the bracket 162 on the track 98.

Figure 8:
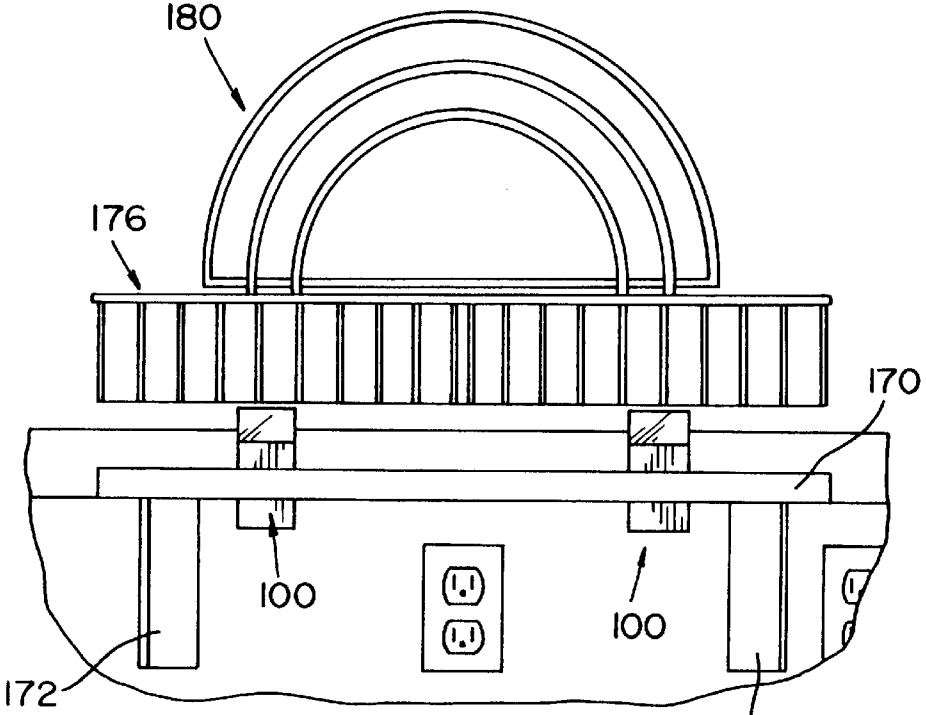
FIG. 8 is a front view illustrating the vertically stackable accessories coupled to the top track of the head wall as shown in FIG. 7.
Figure 7:
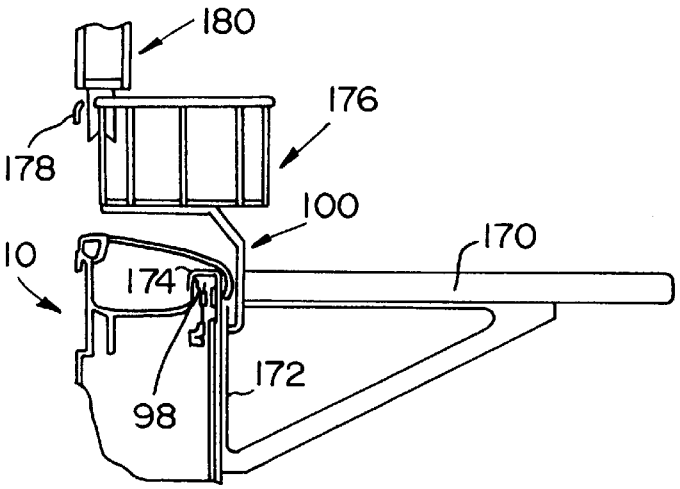
FIG. 7 is a sectional view illustrating vertically stackable accessories coupled to the top track of the head wall, including a utility shelf having mounting brackets coupled to the track of the head wall, a wire basket having additional mounting brackets coupled to the track of the head wall, and a wire frame chart holder connected either to the wire basket or to the top track of the head wall.

It is understood that any desired accessory item may be mounted on the head wall 10 using the mounting techniques of the present invention. FIGS. 7 and 8 illustrate possible items which can be coupled to the head wall 110. In FIG. 7, a large utility shelf 170 includes a pair of spaced apart mounting brackets 172. Each of the mounting brackets 172 includes a U-shaped top section 174 configured to engage the top track 98 of head wall 10.

Also in FIGS. 7 and 8 another accessory item, illustratively a wire frame basket 176 is secured to head wall 10 over the top of shelf 170 using mounting brackets 100 as disclosed in FIG. 4. The basket 176 is secured to horizontal section 108 of mounting bracket 100.

As illustrated in FIG. 8, the mounting brackets 100 are located at different horizontal positions on the head wall 10 relative to mounting brackets 172. This permits vertical stacking or nesting of accessory items on the track 98 of the head wall. Illustratively, shelf 170 and basket 176 are stacked vertically on the head wall 110. In other words, the accessory items 170 and 176 are nestable to conserve space on the head wall. Illustratively, wire basket 176 also includes mounting clips 178 to permit the basket 176 to be mounted directly to top track 98 of head wall 10, if desired.

A third accessory item, illustratively a wire frame chart holder 180 is coupled to the second accessory item, illustratively wire basket 176. In addition, the third accessory item 180 may be coupled directly to the head wall track 98 using suitably shaped mounting brackets. Therefore, the present invention permits several accessory items to be vertically stacked or nested to conserve space along the head wall 10.

Figure 9:
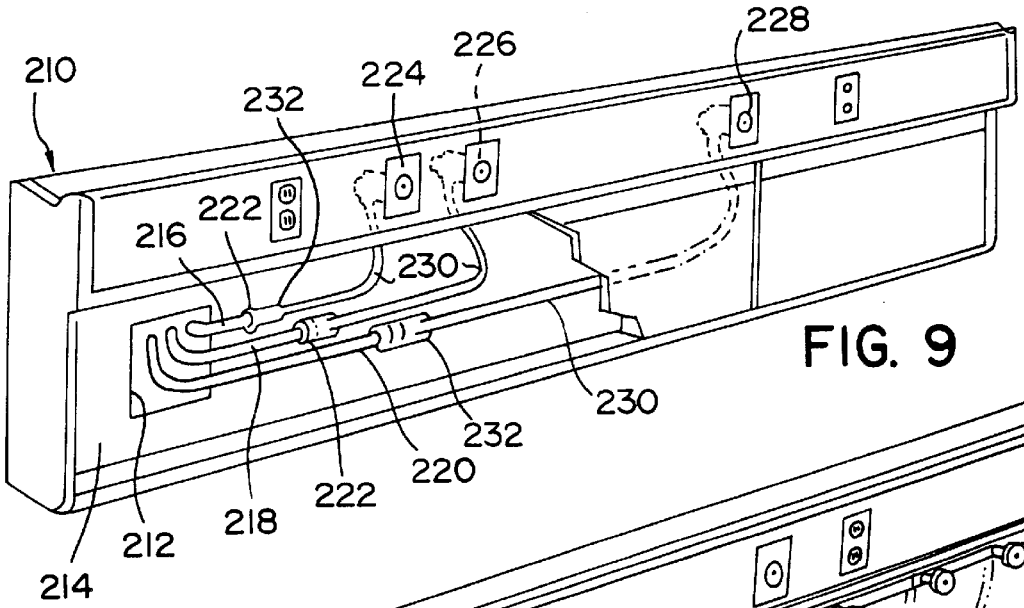
FIG. 9 is a perspective view illustrating an initial head wall installation including copper inlet into the head wall and single flexible hoses having one end coupled to a check valve on each inlet line and another end coupled to a gas block.
Figure 10:
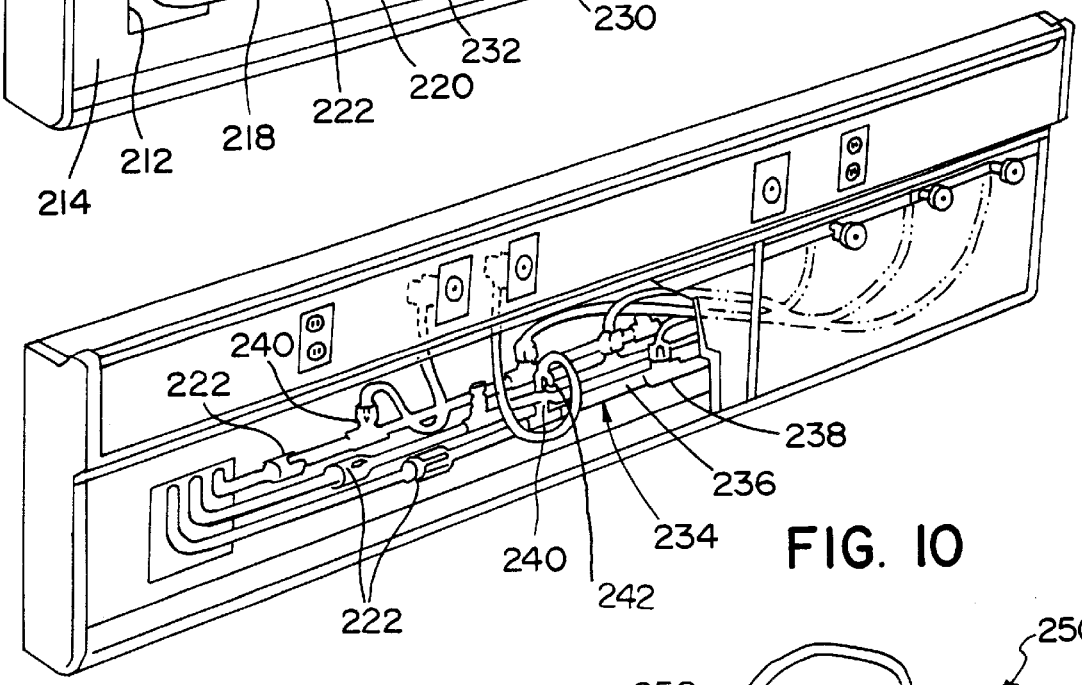
FIG. 10 is a perspective view of another embodiment of the head wall of the present invention which includes an upgraded manifold coupled to the check valve of the inlet line, the manifold including a plurality of T-connections having check valves for coupling each inlet line to a plurality of gas blocks.
Figure 11:
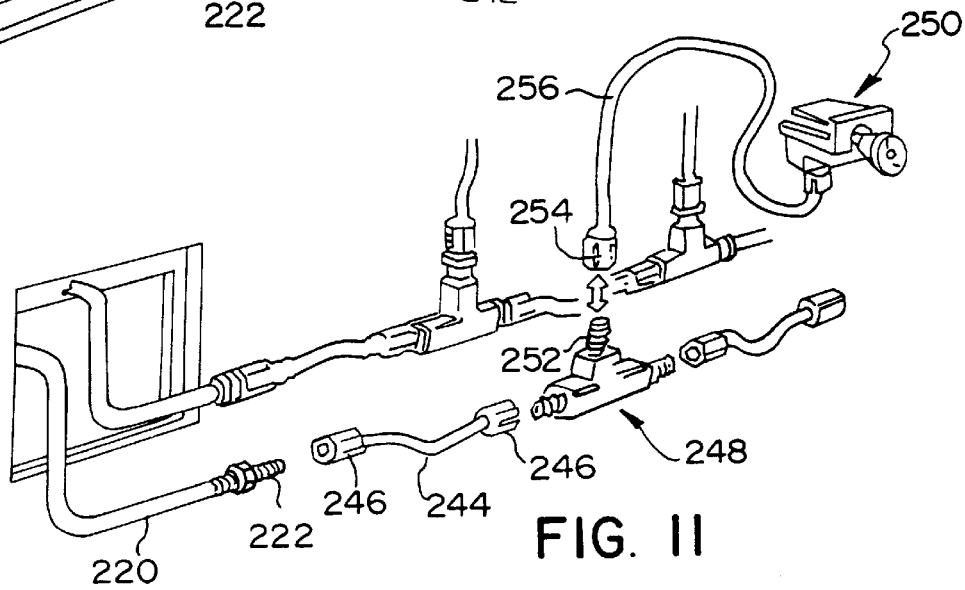
FIG. 11 is a perspective view illustrating a modular manifold upgrade for the head wall in which separate T-connector manifold blocks are coupled to the check valve of the inlet lines by flexible hose couplers so that any desired number of modular manifold blocks can be coupled to the inlet line in order to connect a plurality of gas outlet blocks to each inlet line.

Another feature of the present invention is illustrated in FIGS. 9–11. This feature facilitates upgrading of a hospital room when additional gas outlets are required. An initial installation of a head wall 210 is illustrated in FIG. 9. The head wall 210 includes an aperture 212 formed in a rear panel 214 to permit main supply inlet lines 216, 218, and 220 to enter the head wall 210 from the hospital wall. Inlet lines 216, 218, and 220 supply air, vacuum, and oxygen, respectively, to the head wall 210. A check valve 222 is coupled to the end of each inlet line 216, 218, and 220. Fixed outlets 224, 226, and 228 are coupled to head wall 210. The outlets 224, 226, and 228 are each coupled to a respective input line 216, 218, and 220 by flexible hoses 230 and gas specific threaded couplings 232.

When the hospital needs to add extra gas or vacuum outlet blocks to the hospital room, the original connectors 232 and hoses 230 are removed from the inlet line check valves 222. An upgraded manifold assembly 234 is then coupled to each of the check valves 222. The manifold assemblies include a main tube 236 having spaced apart T-shaped couplers 238. Each coupler 238 includes a check valve 240. Additional gas outlets are then added and coupled to the additional check valves 240. This improved manifold 234 facilitates rapid and inexpensive upgrading of the number of gas and vacuum outlets available on the head wall 210. A manifold 234 can be added quickly for upgrading. In conventional devices, additional copper tubes were brazed to the copper inlet lines 216, 218, and 220 when additional outlets were required. In the present invention, each new outlet is coupled to the check valve 240 by gas specific threaded couplers 242.

FIG. 11 illustrates another embodiment for upgrading the number of gas or vacuum outlets available on the head wall 10. In this embodiment, the original hoses 230 and couplers 232 are disconnected from the inlet lines 216, 218, and 222. Individual coupling lines 244 having couplers 246 located at opposite ends are then connected to the check valves 222. T-shaped connector manifold blocks 248 are then coupled to the connectors 246. Each manifold block 248 includes internal check valve. The new gas outlet 250 is coupled to an outlet 252 of manifold block 248 by a suitable coupler 254 and hose 256. The modular manifold of FIG. 11 facilitates adding additional gas and vacuum outlet blocks to the head wall 210.

Figure 13:
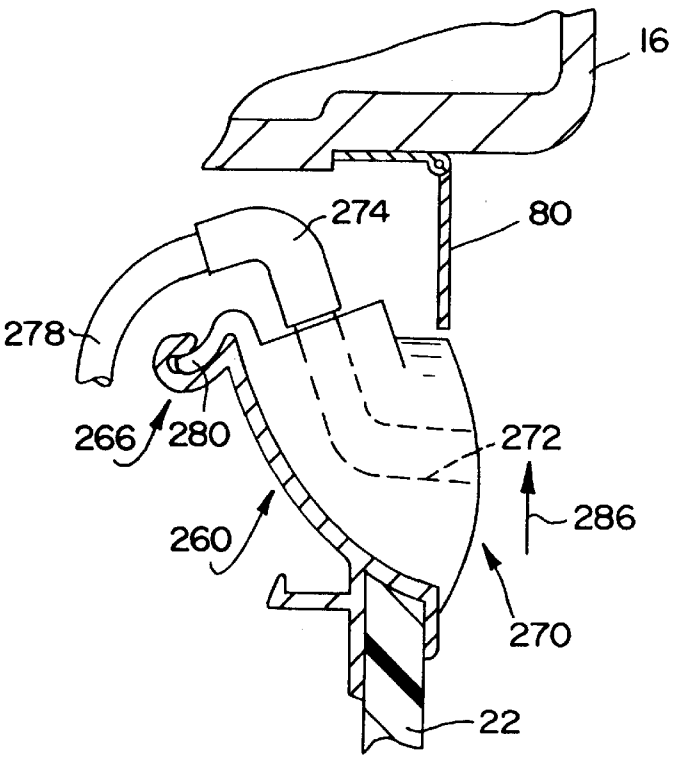
FIG. 13 is a sectional view of the embodiment of FIG. 12 after the gas block has been installed on the top shield and the front hose panel has been pivoted to its in normal use position.
Figure 12:
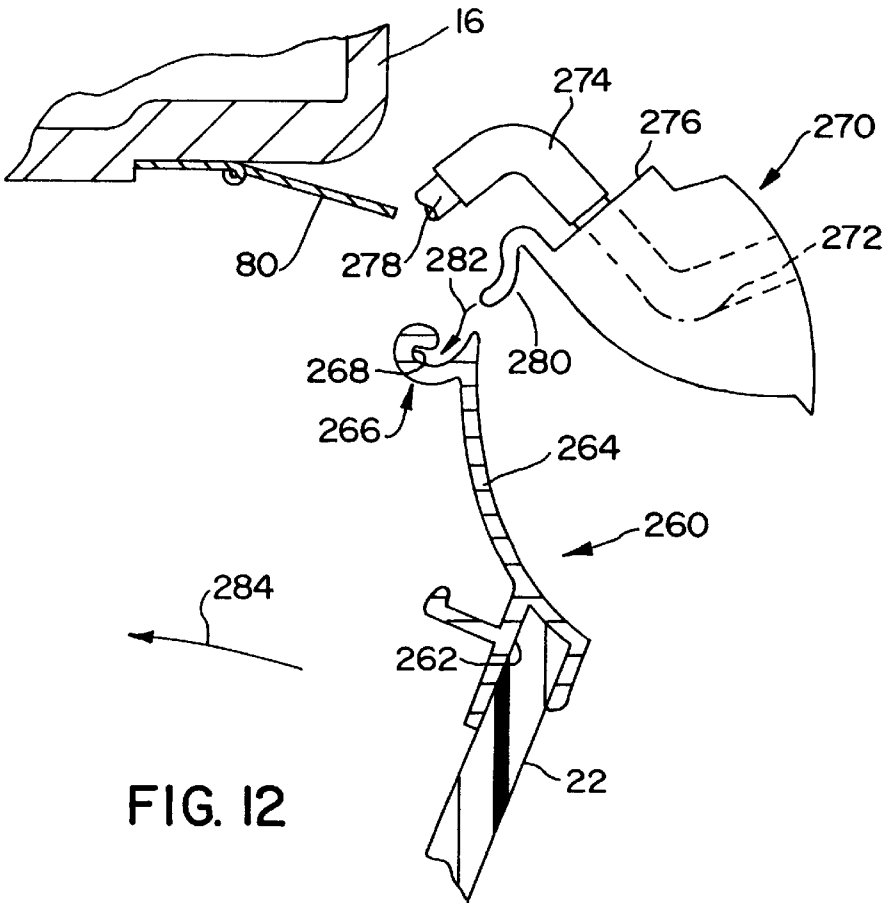
FIG. 12 is a partial sectional view of another embodiment of the head wall having a different configuration for the top shield and the sliding adjustable gas block.

Another embodiment of the present invention is illustrated in FIGS. 12 and 13. Those elements referenced by the same numbers as FIGS. 1–3 perform the same or similar function. The embodiment of FIGS. 12 and 13 includes a modified shield 260 having a U-shaped channel 262 located over a top end of front hose panel 22. The shield also includes a curved body portion 264 and an upper track member 266. Track member 266 is formed to provide a curved slot 268. Illustratively, top shield 260 is formed from an extruded aluminum material.

Gas block 270 includes an internal passageway 272. A swivel connection 274 is rotatably coupled to a rear surface 276 of gas block 270. Swivel connection 274 permits a gas supply hose 278 to be coupled to an inlet end of gas block 270. Gas block 270 is formed to include a curved rear flange or lip 280 having a generally S-shape. The curve of lip 280 matches the configuration of the slot 268 of track member 266. Illustratively, gas block 270 is made from an extruded aluminum material.

In order to install the gas block 270 onto the shield 260, the front hose panel 28 is pivoted outwardly to the position shown in FIG. 12. Gas block 270 is aligned at an angle relative to shield 260 as shown in FIG. 12 so that an end of lip 280 can enter the slot 268 in the direction of arrow 282. Once the gas block 270 is installed, the front hose panel 22 is pivoted in the direction of arrow 284 to the in-use position shown in FIG. 13.

The gas block 270 is free to slide within the track member 266 to a desired location along the head wall. The slidable coupling between the gas block 270 and shield 260 permits the gas block 270 to pivot or move upwardly in the direction of arrow 286 of FIG. 13 while remaining engaged with the track member 266 of the shield 260. Therefore, if an item contacts the gas block 270, it is free to move upwardly without disengaging itself from the shield 260.

Although the invention has been described in detail with reference to a certain preferred embodiment, variations and modifications exist within the scope and spirit of the present invention as described and defined in the following claims.

What is claimed is:

1. A head wall apparatus comprising:

a support configured to be coupled to a wall;

a front panel coupled to the support to define an interior region of the head wall, the front panel including an elongated opening having a top and bottom;

a gas block having an inlet and an outlet;

a shield extending from the bottom of the opening into the interior region and terminating at a top edge which is spaced horizontally and adjacent the top of the opening, the shield defining a track for slidably coupling the gas block to the head wall; and a gas supply line located in the interior region and being coupled to the inlet of the gas block in the interior region.

2. The apparatus of claim 1, wherein the shield includes an upwardly extending wall defining the track.

3. The apparatus of claim 2, wherein the upwardly extending wall is curved inwardly toward the interior region of the head wall.

4. The apparatus of claim 2, wherein the gas block includes a groove receiving a top end of the upwardly extending wall of the shield.

5. The apparatus of claim 1, wherein the shield includes a U-shaped channel coupling the shield to the front panel.

6. The apparatus of claim 1, wherein the shield is coupled to the support below the front panel.

7. The apparatus of claim 6, wherein the shield includes an upwardly extending wall defining the track and a bottom surface defining a bottom cap of the head wall.

8. The apparatus of claim 1, wherein the shield is coupled to the front panel, and further comprising a mounting bracket for pivotably coupling the front panel, the shield, and the gas block to the support.

9. The apparatus of claim 8, further comprising a pivotable door coupled to the support, the door being movable from a first closed position to hold the front panel, the shield, and the gas block in place on the head wall, to a second open position to permit pivotable movement of the front panel, the shield, and the gas block relative to the support.

10. The apparatus of claim 1, wherein the outlet of the gas block is located vertically spaced apart below the inlet of the gas block to permit gas flow around the shield.

11. The apparatus of claim 1, further comprising an L-shaped swivel connector coupled to the inlet of the gas block and to the gas supply line, the swivel connector being rotatable relative to the gas block.

12. The apparatus of claim 1, wherein the shield includes a lower end coupled to the front panel and an upper end configured to define a slot to provide the track, the gas block having a lip configured to enter the slot to slidably couple the gas block to the shield.

13. The apparatus of claim 12, wherein the slot defining the track is curved and the lip is generally S-shaped.

14. A head wall apparatus for supplying gas and electrical power to a hospital room, the apparatus comprising:

a support configured to be mounted to a wall, the support having a front wall, a rear wall, and a recessed top surface extending between the front wall and the rear wall; and a cover pivotably coupled to the rear wall of the support, the cover being spaced apart from the top surface and extending to the front wall to define a storage compartment between the cover and the top surface of the support, and the cover being spaced apart from a top of the front wall to define a track between the cover and the top of the front wall.

15. The apparatus of claim 14, wherein the cover includes a stop configured to engage the rear wall of the support to limit pivotable movement of the cover relative to the support to define the track.

16. A head wall apparatus for supplying gas and electrical power to a hospital room, the apparatus comprising:

a support configured to be mounted on a wall, the support having a front wall and a rear wall;

outlets in the front wall;

a front cover having a top end and a bottom end, the bottom end of the upper front cover being pivotably coupled to the support, and the front cover concealing the outlets on the front wall in a concealed position; and a lock coupled to the support above the pivot of the front cover, the lock engages the top end of the front cover to hold the front cover in the concealed position.

17. A head wall apparatus for supplying gas and electrical power to a hospital room, the apparatus comprising:

a support configured to be coupled to a wall of the hospital room, the support including a front wall defining a track and a back wall;

a first accessory item coupled to the track by at least one first mounting bracket, the first accessory item being spaced from the front wall; and a second accessory item coupled to the track by at least one second mounting bracket in the space between the first accessory item and the front wall, the second accessory item being located vertically above the first accessory item so that the second accessory item overlaps the first accessory item along a horizontal axis of the head wall.

18. The apparatus of claim 17, further comprising a third accessory item coupled to the second accessory item, the third accessory item overlapping the first and second accessory items along the horizontal axis.

19. A head wall apparatus configured to be mounted on a wall, the apparatus comprising:

a support configured to be coupled to the wall;

a front panel coupled to the support to define an interior region of the head wall;

a gas supply line extending into the interior region;

a check valve coupled to the gas supply line;

a manifold in the interior region having an inlet coupled to the check valve and a plurality of T-connectors, each T-connector including an outlet with a check valve;

at least one gas block on the head wall and having an inlet in the interior region; and a gas line in the interior region and connecting the inlet of the gas block to the outlet of the T-connector of the manifold.

20. The apparatus of claim 19, wherein the manifold includes a plurality of separate manifold blocks releasably interconnected by coupling lines.

21. A head wall apparatus comprising:

a support configured to be coupled to a wall;

a front panel coupled to the support to define an interior region of the head wall, the front panel including an elongated opening;

a shield extending across the opening to limit access to the interior through the opening to a substantially horizontal slot, the shield defining a track;

a gas block having an inlet and an outlet and being slidably coupled to the shield; and a gas supply line located in the interior region and being coupled to the inlet of the gas block in the interior region.

22. The apparatus of claim 21, wherein the front panel includes a pair of spaced horizontal elongated openings; and a pair of shields extending across a respective opening to limit access to the interior through the opening to a substantially horizontal slot.

23. A head wall apparatus comprising:

a support configured to be coupled to a wall;

a front panel coupled to the support to define an interior region of the head wall, the front panel including a pair of vertically spaced elongated openings;

a track in each of the openings;

a gas block having an inlet in the interior region and an outlet and being slidably coupled to either of the tracks;

a gas supply line located in the interior region; and an L-shaped swivel connector coupled to the inlet of the gas block and to the gas supply line, the swivel connector being rotatable relative to the gas block.

24. A head wall apparatus for supplying gas and electrical power to a hospital room, the apparatus comprising:

a support configured to be mounted to a wall, the support having a front wall, a rear wall, and a recessed top surface extending between the front wall and the rear wall; and a cover pivotably coupled to the rear wall of the support, the cover being spaced apart from the top surface and extending to the front wall to define a storage compartment between the cover and the top surface of the support, and the cover includes first and second portions pivotably coupled together so that the cover is foldable to lie on the top surface between the front wall and the rear wall.

25. The apparatus of claim 16, wherein the lock includes a top cover pivotably coupled to the rear wall of the support at a first end and engages the top end of the front cover at a second end.

26. The apparatus of claim 16, wherein the support includes a recessed top surface extending between the front wall and the rear wall, and a top cover covers the recess and forms the lock.

27. The apparatus of claim 26, wherein the top cover is pivotally connected to the rear wall.

28. The apparatus of claim 17, wherein at one of the mounting brackets is a lockable mounting bracket for mounting an accessory item to the track.

29. The apparatus of claim 17, wherein the second mounting bracket includes a first U-shaped portion engaging the track and a platform extending over the front wall towards the back wall of the support and the second accessory item is mounted to the platform.

* * * * *